US008568539B2

(12) United States Patent
Horiuchi et al.

(10) Patent No.: US 8,568,539 B2
(45) Date of Patent: Oct. 29, 2013

(54) PERMANENT MAGNET AND METHOD FOR MANUFACTURING THE SAME, AND MOTOR AND POWER GENERATOR USING THE SAME

(75) Inventors: Yosuke Horiuchi, Minato-ku (JP); Shinya Sakurada, Shinagawa-ku (JP); Keiko Okamoto, Kawasaki (JP); Masaya Hagiwara, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 96 days.

(21) Appl. No.: 13/072,124

(22) Filed: Mar. 25, 2011

(65) Prior Publication Data

US 2011/0241810 A1 Oct. 6, 2011

(30) Foreign Application Priority Data

Mar. 31, 2010 (JP) ..... 2010-084334

(51) Int. Cl.
*H01F 1/055* (2006.01)
*H01F 1/08* (2006.01)

(52) U.S. Cl.
USPC ..... 148/303; 148/102; 75/232; 419/20

(58) Field of Classification Search
USPC ..... 148/302, 101–103, 303; 419/20; 75/232
See application file for complete search history.

(56) References Cited

U.S. PATENT DOCUMENTS

| | | | | |
|---|---|---|---|---|
| 3,639,181 | A * | 2/1972 | Cech | 428/567 |
| 3,785,881 | A * | 1/1974 | Naastepad et al. | 148/103 |
| 4,099,995 | A * | 7/1978 | Menth et al. | 148/101 |
| 6,273,966 | B1 * | 8/2001 | Snodgrass et al. | 148/301 |
| 6,623,541 | B2 * | 9/2003 | Sakaki et al. | 75/232 |
| 6,726,781 | B2 * | 4/2004 | Walmer et al. | 148/303 |
| 2008/0277028 | A1 * | 11/2008 | Sakaki et al. | 148/102 |
| 2009/0261774 | A1 | 10/2009 | Yuuki et al. | |

FOREIGN PATENT DOCUMENTS

| | | | |
|---|---|---|---|
| EP | 2 048 772 | | 4/2009 |
| GB | 2 021 147 | A * | 3/1979 |
| JP | 56-93848 | | 7/1981 |
| JP | 58-180005 | | 10/1983 |
| JP | 9-111383 | | 4/1997 |
| JP | 10-92617 | | 4/1998 |
| JP | 2008-29148 | | 2/2008 |
| JP | 2008-043172 | | 2/2008 |

OTHER PUBLICATIONS

Kang, Suk-Joong L., Sintering: Densification, Grain Growth, and Microstructure, Elsevier Butterworth-Heinemann, 2005, pp. 3-8.*

* cited by examiner

*Primary Examiner* — Roy King
*Assistant Examiner* — Timothy Haug
(74) *Attorney, Agent, or Firm* — Oblon, Spivak, McClelland, Maier & Neustadt, L.L.P.

(57) ABSTRACT

According to one embodiment, a permanent magnet is provided with a sintered body having a composition represented by $R(Fe_pM_qCu_rCo_{1-p-q-r})_zO_w$ (where, R is at least one element selected from rare-earth elements, M is at least one element selected from Ti, Zr and Hf, and p, q, r, z and w are numbers satisfying $0.25 \le p \le 0.6$, $0.005 \le q \le 0.1$, $0.01 \le r \le 0.1$, $4 \le z \le 9$ and $0.005 \le w \le 0.6$ in terms of atomic ratio). The sintered body has therein aggregates of oxides containing the element R dispersed substantially uniformly.

14 Claims, 6 Drawing Sheets

PERMANENT MAGNET AND METHOD FOR MANUFACTURING THE SAME, AND MOTOR AND POWER GENERATOR USING THE SAME

CROSS-REFERENCE TO RELATED APPLICATION

This application is based upon and claims the benefit of priority from Japanese Patent Application No. 2010-084334, filed on Mar. 31, 2010; the entire contents of which are incorporated herein by reference.

FIELD

Embodiments described herein relate generally to a permanent magnet and a method for manufacturing the same, and to a motor and a power generator using the same.

BACKGROUND

As a high-performance permanent magnet, rare-earth magnets such as Sm—Co based magnets and Nd—Fe—B based magnets are known and being used for electric appliances such as motors, power generators and the like. The electric appliances using a permanent magnet are increasingly demanded to reduce size, weight and power consumption, and therefore to comply with the demands, the permanent magnets are demanded to have higher performance. When the permanent magnet is used for motors of hybrid electric vehicles (HEV) and electric vehicles (EV), the permanent magnet is demanded to have heat resistance.

For motors for the HEV and EV, there is used a permanent magnet with its heat resistance improved by partly substituting the Nd of the Nd—Fe—B based magnet with Dy. Since the Dy is one of rare elements, there are demands for a permanent magnet not using the Dy. As highly efficient motors and power generators, there are known variable magnetic flux motors and variable magnetic flux generators using two types of magnets such as a variable magnet and a stationary magnet. For the variable magnet, Al—Ni—Co based magnets and Fe—Cr—Co based magnets are used. To provide the variable magnetic flux motors and the variable magnetic flux generators with high performance and high efficiency, it is demanded to enhance the coercive force and magnetic flux density of the variable magnets and stationary magnets.

It is known that the Sm—Co based magnet showing excellent heat resistance is a type not using the Dy. It is also considered that it is possible to use as a variable magnet an $Sm_2Co_{17}$ type magnet among the Sm—Co based magnets on the basis of its coercive force exhibiting mechanism and the like.

DETAILED DESCRIPTION

Figure 1A:
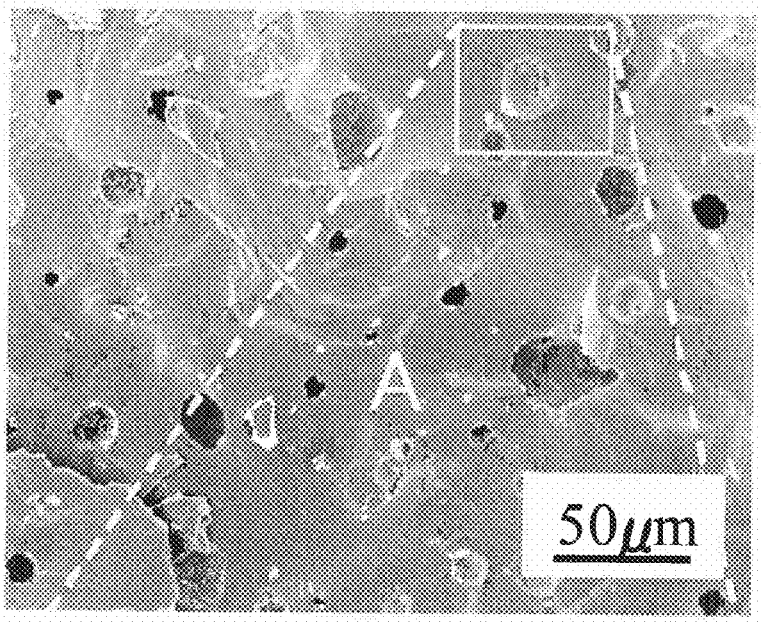
FIG. 1A and FIG. 1B are SEM images showing textures of a sintered body configuring a permanent magnet.

According to an embodiment, there is provided a permanent magnet provided with a sintered body having a composition represented by a composition formula:

$$R(Fe_pM_qCu_rCo_{1-p-q-r})_zO_w \quad (1)$$

(where, R is at least one element selected from rare-earth elements, M is at least one element selected from Ti, Zr and Hf, and p, q, r, z and w are numbers satisfying $0.25 \le p \le 0.6$, $0.005 \le q \le 0.1$, $0.01 \le r \le 0.1$, $4 \le z \le 9$ and $0.005 \le w \le 0.6$ in terms of atomic ratio). Aggregates of oxides containing the element R are substantially uniformly dispersed in the sintered body configuring the permanent magnet.

The Sm—Co based magnets are known that they are of a type not using Dy and show good heat resistance. Among the Sm—Co based magnets, an $Sm_2Co_{17}$ type magnet can be applied to both of the variable magnet and the stationary magnet of the variable magnetic flux motor and the variable magnetic flux generator. The $Sm_2Co_{17}$ type magnet is excellent in coercive force and maximum magnetic energy product but costs high because it contains a large amount of cobalt and has a magnetic flux density smaller than a magnet which is mainly comprised of iron. To improve the magnetic flux density of the $Sm_2Co_{17}$ type magnet, it is effective to increase an iron concentration. In addition, the $Sm_2Co_{17}$ type magnet can be made inexpensive by increasing the iron concentration.

But, when the iron concentration in the magnetic powder used as a forming material of the $Sm_2Co_{17}$ type magnet is increased, sinterability of the magnetic powder is degraded, and there is a tendency that the density of the sintered body constituting the permanent magnet decreases. The decrease of density of the sintered body results in decrease of the magnetization. By the permanent magnet of this embodiment, the iron concentration in the Sm—Co based magnet is increased, and sinterability in the magnetic powder used as the Sm—Co based magnet forming material can be improved. Thus, it becomes possible to provide the Sm—Co based magnet with its magnetization improved.

The permanent magnet of the embodiment is described below. The permanent magnet of this embodiment has a composition represented by the formula (1). In the formula (1), at least one element selected from rare-earth elements containing yttrium (Y) is used as the element R. The element R brings a large magnetic anisotropy to the magnet material to give a high coercive force. As the element R, at least one element selected from samarium (Sm), neodymium (Nd) and praseodymium (Pr) is preferably used, and the Sm is used more preferably. The performance of the permanent magnet, and particularly the coercive force, can be enhanced with a good reproducibility by having 50 atomic % or more of the element R replaced by the Sm. In addition, it is desirable that 70 atomic % or more of the element R is the Sm.

The element R is blended so that an atomic ratio of the element R and other elements (Fe, M, Cu and Co) becomes a range of 1:6 to 1:9 (as z value, a range of 6 to 9/as the contained amount of the element R, a range of 10 to 20 atomic %). If the content of the element R is less than 10 atomic %, a large amount of α-Fe phase precipitates, and a sufficient coercive force cannot be obtained. Meanwhile, if the content of the element R exceeds 20 atomic %, a saturation magnetization is decreased considerably. The content of the element R is preferably in a range of 10 to 15 atomic %, and more preferably in a range of 10.5 to 12.5 atomic %.

Iron (Fe) serves mainly to magnetize the permanent magnet. When a large amount of Fe is blended, the saturation magnetization of the permanent magnet can be enhanced. But, when the Fe content becomes excessive, the α-Fe phase is precipitated or a two-phase texture of 2-17 phase and 1-5 phase described later becomes difficult to obtain. Therefore, the coercive force of the permanent magnet lowers. The blending amount of Fe is determined to be in a range of 25 to 60 atomic % ($0.25 \leq p \leq 0.6$) of a total amount of the elements (Fe, M, Cu and Co) other than the element R. The blending amount of Fe is preferably $0.26 \leq p \leq 0.5$, and more preferably $0.28 \leq p \leq 0.4$.

For the element M, at least one element selected from titanium (Ti), zirconium (Zr) and hafnium (Hf) is used. By blending the element M, a large coercive force can be exhibited by a composition having a high iron concentration. The contained amount of the element M is determined to be in a range of 0.5 to 10 atomic % ($0.005 \leq q \leq 0.1$) of a total amount of the elements (Fe, M, Cu and Co) other than the element R. When a q value exceeds 0.1, a decrease in magnetization is considerable. When the q value is less than 0.005, an effect of enhancing the iron concentration is small. The contained amount of the element M is preferably $0.01 \leq q \leq 0.06$, and more preferably $0.015 \leq q \leq 0.04$.

The element M may be any of Ti, Zr and Hf, and it is preferable to contain at least Zr. By having the Zr for 50 atomic % or more of the element M, the effect of enhancing the coercive force of the permanent magnet can be improved. When the Hf is used, its used amount is preferably small because the Hf is particularly expensive among the element M. The contained amount of the Hf is preferably less than 20 atomic % of the element M.

Copper (Cu) is an element for making the permanent magnet to exhibit a high coercive force. The contained amount of the Cu is determined to be in a range of 1 to 10 atomic % ($0.01 \leq r \leq 0.1$) of a total amount of the elements (Fe, M, Cu and Co) other than the element R. When the r value exceeds 0.1, a decrease in magnetization is considerable. When the r value is less than 0.01, it becomes difficult to obtain the coercive force. The contained amount of the Cu is preferably $0.02 \leq r \leq 0.1$, and more preferably $0.03 \leq r \leq 0.08$.

Cobalt (Co) is an element which serves to magnetize the permanent magnet and required to exhibit a high coercive force. In addition, when the Co is contained in a large amount, a Curie temperature becomes high, and the thermal stability of the permanent magnet is also improved. When the blending amount of the Co is small, the above effects become less effective. But, when the Co is excessively contained in the permanent magnet, the content of Fe is relatively decreased, and magnetization might be decreased. The contained amount of the Co is determined to be in a range of (1-p-q-r) defined by p, q and r.

The Co may be partly substituted by at least one element A selected from nickel (Ni), vanadium (V), chromium (Cr), manganese (Mn), aluminum (Al), silicon (Si), gallium (Ga), niobium (Nb), tantalum (Ta) and tungsten (W). These substitution elements contribute to improvement of the magnet characteristics, such as a coercive force. When the Co is excessively substituted by the element A, magnetization might be decreased, so that the substitution amount by the element A is preferably determined to be 20 atomic % or less of the Co.

The permanent magnet of this embodiment preferably has a texture that a $Th_2Zn_{17}$ crystal phase (crystal phase having $Th_2Zn_{17}$ type structure/2-17 phase) is a main phase. According to the permanent magnet having the $Th_2Zn_{17}$ crystal phase as the main phase, high magnet characteristics such as a high coercive force can be obtained. The main phase means a phase having a maximum volume ratio among the constituent phases such as a crystal phase and a amorphous phase configuring the permanent magnet. It is preferable that the $Th_2Zn_{17}$ crystal phase (main phase) has a volume ratio of 50% or more.

The texture of the permanent magnet includes preferably a $CaCu_5$ crystal phase (crystal phase having a $CaCu_5$ type structure/1-5 phase) or the like as a grain boundary phase other than the $Th_2Zn_{17}$ crystal phase as the main phase. The permanent magnet has preferably a two-phase separated texture of the $Th_2Zn_{17}$ crystal phase (2-17 phase) and the $CaCu_5$ crystal phase (1-5 phase). Thus, the high magnet characteristics can be obtained. Inclusion of phases other than the above two phases is not excluded, but it is preferable that the texture of the permanent magnet is substantially comprised of the two phases of the $Th_2Zn_{17}$ crystal phase and the $CaCu_5$ crystal phase.

A volume ratio of individual phases (alloy phases) configuring the texture of the permanent magnet is comprehensively determined with a combination of examinations under an electron microscope or an optical microscope and X-ray diffraction or the like but can be determined by an area analysis method using a transmission electron micrograph obtained by photographing a cross section (hard-to-magnetize axis surface) of the permanent magnet. The cross section of the permanent magnet is a cross section of substantially the center portion of the surface having a maximal area in the magnet surface.

The permanent magnet of this embodiment is provided with a sintered body having the composition represented by the formula (1). The sintered body configuring the permanent magnet is manufactured by press forming the magnetic powder in the magnetic field and sintering the obtained formed body. For example, the sintered body configuring the permanent magnet of this embodiment is manufactured as follows.

First, the magnetic powder (alloy powder) containing a predetermined amount of each element is manufactured. The magnetic powder is prepared by manufacturing an alloy in flake form by, for example, a strip casting method and crushing. According to the strip casting method, a molten alloy is poured into a cooling roll which rotates preferably at a circumferential velocity of 0.1 to 20 m/sec and solidified continuously to obtain a thin strip with a thickness of 1 mm or less. When the cooling roll has a circumferential velocity of less than 0.1 m/sec, the composition tends to become variable in the thin strip, and when the circumferential velocity exceeds 20 m/sec, the crystal grains are miniaturized into a single-domain size or less, and good magnetic characteristics might not be obtained. The circumferential velocity of the cooling roll is more preferably in a range of 0.3 to 15 m/sec, and still more preferably in a range of 0.5 to 12 m/sec.

The magnetic powder may be prepared by crushing the alloy ingot obtained by casting the molten metal according to an arc melting method or a high-frequency melting method. Another method of preparing the magnetic powder includes a mechanical alloying method, a mechanical grinding method, a gas atomizing method, a reduction and diffusion method or the like, and the magnetic powder prepared by such a method may be used. The alloy powder obtained as described above or the alloy before crushing may be homogenized by a thermal treatment, if necessary. The flake or the ingot is crushed by a jet mill, a ball mill, or the like. The crushing is preferably performed in an inert gas atmosphere or an organic solvent such as toluene, hexane, ethanol or acetone to prevent the magnetic powder from being oxidized.

The magnetic powder is then filled in a mold disposed in an electromagnet or the like and undergone pressure forming while applying a magnetic field to manufacture a formed body with crystal axes oriented. The formed body is sintered at a temperature of 1100 to 1300° C. for 0.5 to 15 hours to obtain a dense sintered body. If the sintering temperature is less than 1100° C., the sintered body has an insufficient density, and if it exceeds 1300° C., the element R such as Sm in the magnetic powder is evaporated, and good magnetic characteristics cannot be obtained. The sintering temperature is more preferably in a range of 1150 to 1250° C., and still more preferably in a range of 1180 to 1230° C.

If the sintering time is less than 0.5 hour, the sintered body might have a non-uniform density. If the sintering time exceeds 15 hours, the element R such as Sm is evaporated, and good magnetic characteristics cannot be obtained. The sintering time is more preferably in a range of 1 to 10 hours, and still more preferably in a range of 1 to 4 hours. The formed body is preferably sintered in vacuum or in an inert gas atmosphere such as argon gas to prevent oxidation.

The obtained sintered body is performed to solution heat treatment and aging treatment to control the crystalline texture. The solution heat treatment is performed preferably at a temperature in a range of 1130 to 1230° C. for 0.5 to 8 hours to obtain a $TbCu_7$ crystal phase (crystal phase having $TbCu_7$ type structure/1-7 phase) which is a precursor of a phase separation texture. If the temperature is less than 1130° C. or exceeds 1230° C., a ratio of the 1-7 phase in a sample after the solution heat treatment is small, and good magnetic characteristics cannot be obtained. The solution heat treatment temperature is more preferably in a range of 1150 to 1210° C., and still more preferably in a range of 1160 to 1190° C.

If the solution heat treatment time is less than 0.5 hour, the constituent phase tends to become non-uniform. And, if the solution heat treatment is performed more than 8 hours, the element R such as Sm in the sintered body is evaporated, and good magnetic characteristics might not be obtained. The solution heat treatment time is more preferably in a range of 1 to 8 hours, and still more preferably in a range of 1 to 4 hours. The solution heat treatment is preferably performed in vacuum or in an inert gas atmosphere such as argon gas to prevent oxidation.

The sintered body having undergone the solution heat treatment is then performed to the aging treatment. The aging treatment is a treatment to enhance the coercive force of the magnet by controlling the crystalline texture. It is preferable that the aging treatment holds the sintered body at a temperature of 700 to 900° C. for 0.5 to 16 hours as a first-stage heat treatment, cools down to a temperature of 400 to 650° C. at a cooling rate of 0.2 to 2° C./min, holds at that temperature for a predetermined time as a second-stage heat treatment, and subsequently cools down to room temperature by furnace cooling. The aging treatment is preferably performed in vacuum or in an inert gas atmosphere such as argon gas to prevent oxidation.

In the aging treatment, if the first-stage heat treatment temperature is less than 700° C. or exceeds 900° C., a homogeneous mixed texture of a 2-17 phase and a grain boundary phase cannot be obtained, and the magnetic characteristics of the permanent magnet might be degraded. The first-stage heat treatment temperature is more preferably 750 to 900° C., and still more preferably 800 to 880° C.

If the holding time at the first-stage temperature is less than 0.5 hour, there is a possibility that precipitation of the grain boundary phase from the 1-7 phase does not complete sufficiently. Meanwhile, if the holding time exceeds 16 hours, the crystal grains are coarsened, and good magnetic characteristics might not be obtained. When the permanent magnet is used as a variable magnet, the grain boundary phase becomes excessively thick, and the coercive force of the permanent magnet becomes enormous. Therefore, magnet characteristics suitable for the variable magnet cannot be obtained. The holding time at the first stage temperature is more preferably 1 to 12 hours, and still more preferably 2 to 6 hours.

If the cooling rate after the first-stage heat treatment is less than 0.2° C./min, the crystal grains are coarsened, and good magnetic characteristics might not be obtained. When the permanent magnet is used as a variable magnet, the grain boundary phase becomes excessively thick, and the coercive force becomes enormous. Therefore, the magnet characteristics suitable for the variable magnet cannot be obtained. If the cooling rate exceeds 2° C./min, a mixed texture of the homogeneous 2-17 phase and the grain boundary phase cannot be obtained, and the magnetic characteristics of the permanent magnet might be degraded. The cooling rate after the first-stage heat treatment is more preferably in a range of 0.4 to 1.5° C./min, and still more preferably in a range of 0.5 to 1.3° C./min. The aging treatment is not limited to the two-stage heat treatment but may be a much more-stage heat treatment.

Figure 1B:
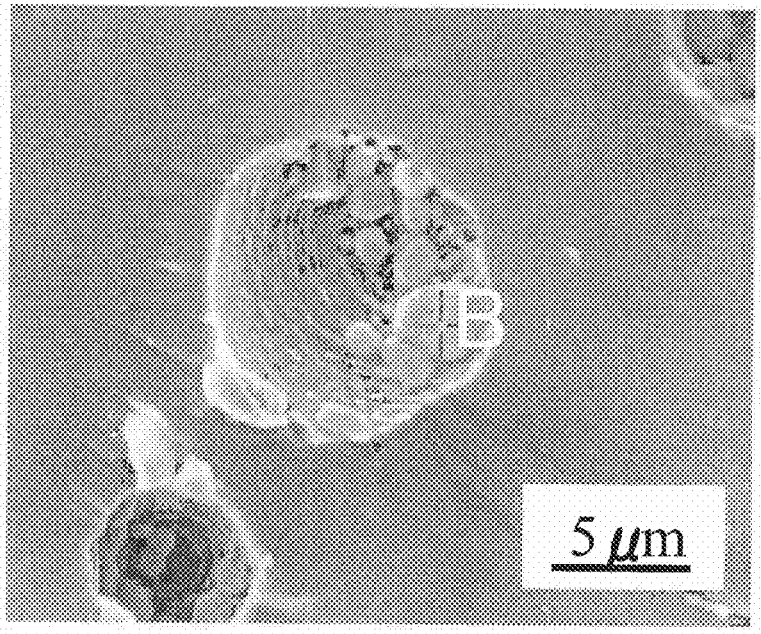

In the permanent magnet made of the sintered body of the magnetic powder described above, if the sintered body has a large amount of oxides, the magnet characteristics such as the coercive force, magnetization and the like are degraded. The oxides contained in the sintered body are mainly those of the element R such as Sm, and specifically $Sm_2O$, SmO, $SmO_2$, $Sm_2O_3$, etc. FIG. 1A and FIG. 1B are SEM images (secondary electron images) showing in a magnified form the texture of the sintered body having a composition using Sm as the element R.

FIG. 1A shows many holes (white and black color portions). FIG. 1B shows one of the holes of FIG. 1A in a magnified form. In FIG. 1B, it is confirmed that the holes have aggregates therein. A portion A (mother phase part of the sintered body) of FIG. 1A and a portion B (aggregate) of FIG. 1B were measured for an oxygen concentration, and it was found that the oxygen concentration of the portion B (aggregate) is considerably larger than that of the portion A (mother phase part of the sintered body).

Figure 2A:
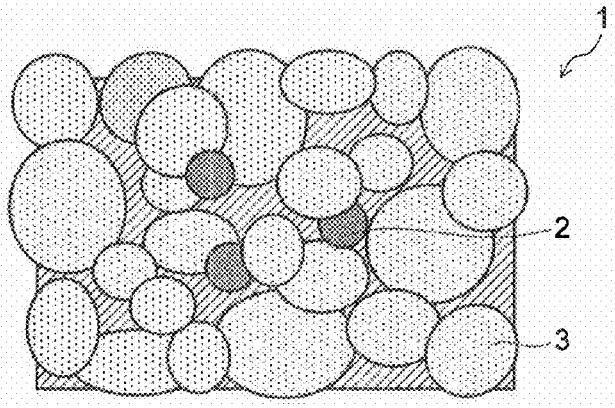
FIGS. 2A to 2C are diagrams schematically showing an example of an oxide aggregation process when magnetic powder is sintered.
Figure 2B:
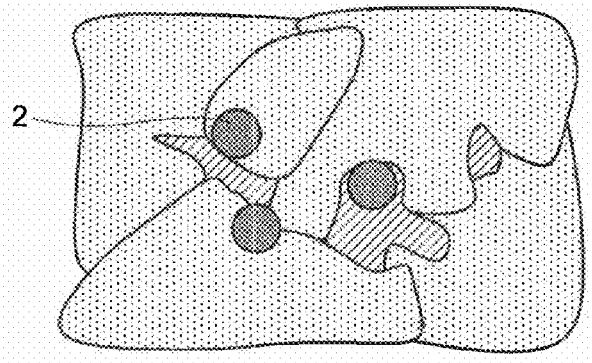
Figure 2C:
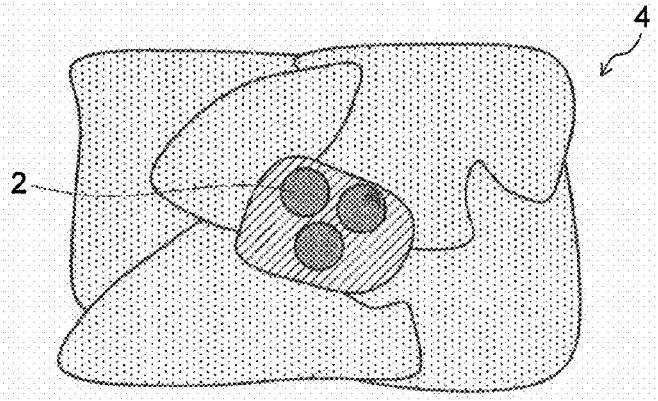
Figure 3A:
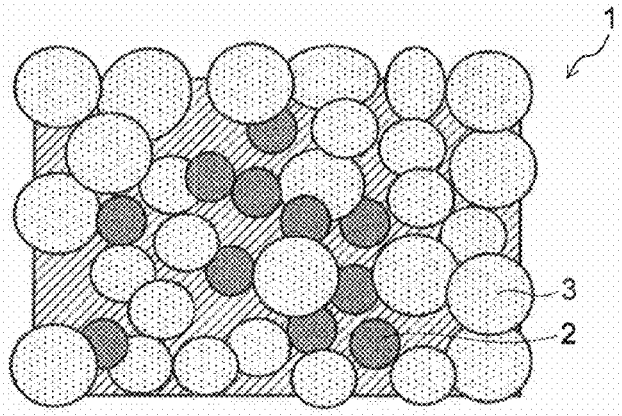
FIGS. 3A to 3C are diagrams schematically showing another example of an oxide aggregation process when magnetic powder is sintered.
Figure 3B:
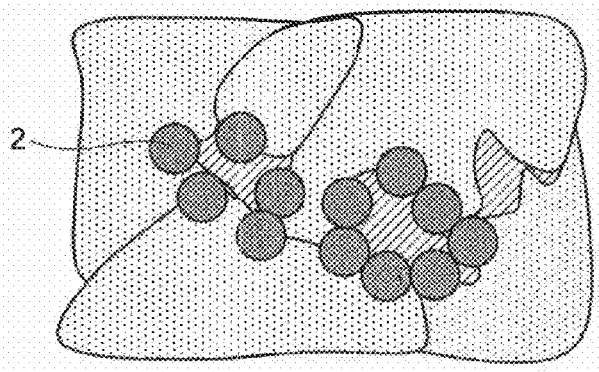
Figure 3C:
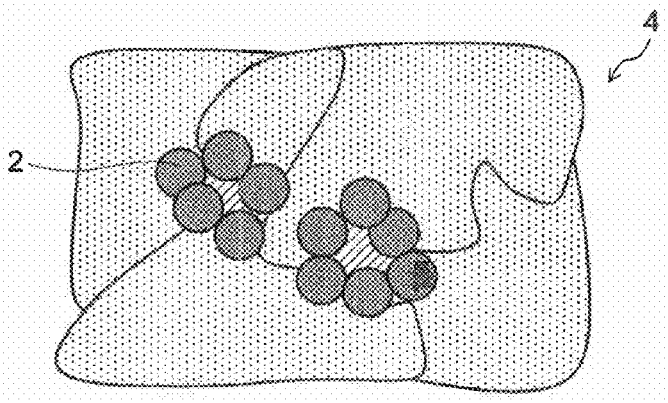

FIGS. 2A to 2C and FIGS. 3A to 3C show schematically oxide aggregation processes at the time of sintering the magnetic powder. FIGS. 2A to 2C are schematic views when relatively large holes have oxide aggregates therein, and FIGS. 3A to 3C are schematic views showing that oxides are excessively contained in gaps among the magnetic powder grains. Among these drawings, FIG. 2A and FIG. 3A show formed bodies 1, FIG. 2B and FIG. 3B show sintering states, and FIG. 2C and FIG. 3C show sintered bodies 4. In the drawings, 2 shows oxides, and 3 shows magnetic powders.

For example, the $Sm_2O_3$ has a melting point of about 2350° C. and seems to be present stably without melting at the above-described sintering temperature of approximately 1200° C. In the sintering process shown in FIGS. 2A to 2C, if the formed body 1 has large holes therein, the oxides 2 remain in the holes and disturb the holes in the formed body 1 from disappearing. Therefore, the sintered body 4 is disturbed from being densified. The aggregate (part B) in FIG. 1B is considered as an aggregate of Sm oxide remained in the holes. Even if the formed body 1 does not have a large hole, the oxides 2 are mutually aggregated in the sintering process shown in FIGS. 3A to 3C when the magnetic powder 3 containing the oxides 2 in a large amount is sintered, gaps are formed among the magnetic powder grains 3, and the density of the sintered body 4 is degraded as a result.

When only the density of the sintered body is considered, the oxide of the element R such as Sm is preferably not contained in the sintered body. But, the existing state of the oxide occasionally becomes a factor of improving the magnet characteristics. That is, the oxide of the element R is stably present in the sintered body even at the above-described sintering temperature, so that it is considered that there is an effect of pinning the movement of the crystal grain boundary and suppressing the crystal grain from coarsening when sintering. When the crystal grains become coarse, the coercive force of the magnet decreases. Therefore, it is preferable that a certain amount of the element R oxide (such as Sm oxide) is present in a state dispersed substantially uniformly without aggregating excessively in the sintered body configuring the permanent magnet. Thus, it becomes possible to improve the magnet characteristics while enhancing the density of the sintered body.

Considering the above point, the sintered body configuring the permanent magnet preferably contains oxygen (O) in an amount that the w value in the formula (1) falls in a range of 0.005 to 0.6. If the w value in the formula (1) is less than 0.005, the oxide of the element R which pins the movement of the crystal grain boundary decreases relatively, and coarsening of the crystal grain is induced. If the w value exceeds 0.6, aggregation of the oxide of the element R such as Sm becomes conspicuous, and the density of the sintered body cannot be enhanced sufficiently. The w value in the formula (1) is more preferably in a range of $0.005 \leq w \leq 0.5$, and still more preferably in a range of $0.01 \leq w \leq 0.4$.

The oxygen concentration in the sintered body can be controlled based on its manufacturing conditions. For example, the oxygen concentration in the sintered body is variable depending on the oxygen concentration when melting, the particle diameter of the powder obtained by crushing the flake or the ingot by a ball mill or a jet mill, the atmosphere when sintering, or the like. For example, if the degree of vacuum when arc-melting is $1\times10^{-2}$ MPa or more, the oxygen concentration in the ingot increases, and the oxygen concentration in the sintered body tends to increase as a result. In such a case, the w value in the formula (1) showing the composition of the sintered body tends to exceed 0.6.

If the particle diameter of the powder obtained by crushing by the ball mill or the jet mill is 40 μm or more, the oxygen content of the sintered body tends to become small because the surface area of the obtained powder is small. In this case, the w value in the formula (1) tends to become less than 0.005. If the degree of vacuum when the magnetic powder is sintered is $1\times10^{-2}$ MPa or more, oxidation is caused by oxygen remaining in the atmosphere when sintering, and the oxygen concentration in the sintered body tends to increase. In this case, the w value in the formula (1) tends to exceed 0.6.

In addition, it is preferable that the element R oxide (such as Sm oxide) is contained in a predetermined amount in the sintered body and in a state not aggregated excessively. Specifically, it is preferable that the aggregates of the oxide of the element R are present in a state dispersed substantially uniformly in the sintered body. In addition, it is preferable that the oxide aggregates have an average diameter of 10 μm or less. Thus, the crystal grains are suppressed from coarsening, and the density of the sintered body can be enhanced. It is more preferable that the oxide aggregates have an average diameter of 8 μm or less.

The state that the aggregates of oxides containing the element R are "dispersed substantially uniformly" in the sintered body means the following state. Referring to FIG. 4, a way of determining the average diameter of the aggregates of oxides and a definition of the state that the aggregates of oxides are substantially uniformly dispersed are described below.

(Step 1)

Figure 4A:
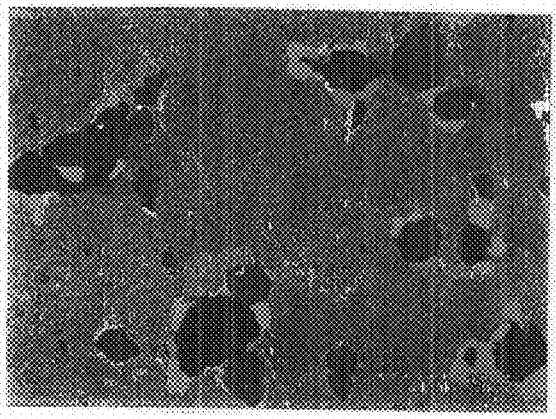
FIGS. 4A to 4C are diagrams showing a procedure of determining an average diameter and a dispersed state of oxide aggregates in a sintered body.

First, the sintered body is observed for the SEM (Scanning Electron Microscope). The sintered body is crushed to a size of about 1 to 3 mm squares, an observation surface is smoothened by polishing, and observation is performed at a magnification of 1000 times. In addition, individual element distributions are checked by EDX (Energy Dispersive X-ray spectroscopy) (FIG. 4A). The oxide aggregates observed on the obtained reflected electron image are measured for a periphery length (hereinafter denoted as L).

(Step 2)

Figure 4B:
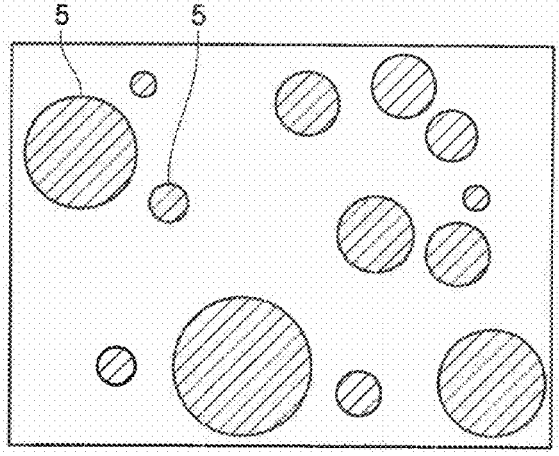

Oxide aggregates 5 having a variety of shapes are projected in circles having a circumference corresponding to the measured periphery length L (FIG. 4B). For centers Oi of the circles, the oxide aggregates observed on a reflected electron image are measured for a barycenter gi, and the barycenter gi is determined as the center Oi. The oxide aggregates having many irregularities are not observed substantially in the sintered body and mostly have an almost elliptical shape. When the oxide aggregate has a shape with many irregularities, a method that determines its barycenter and projects to form circles is approximately preferable. To project an elliptical shape into a circle, a method that calculates an average radius (hereinafter denoted as r) from the periphery length L is approximately preferable. Thus, the radius r ($=L/2\pi$) is calculated from the periphery length L ($=2\pi r$), and the obtained value is used as the radius r to project a circle. The diameter (2r) of the circle is determined as the diameters of the oxide aggregates 5.

(Step 3)

Figure 4C:
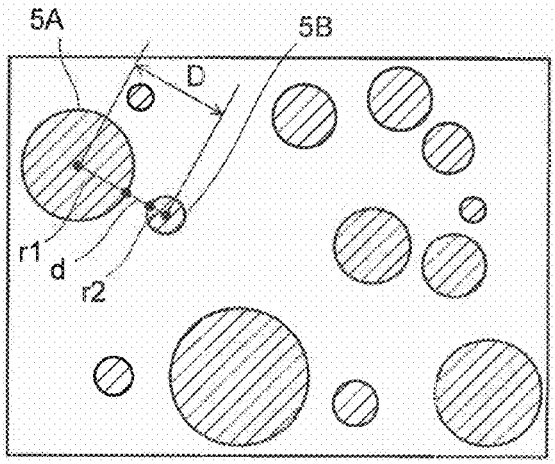

All the oxide aggregates 5 included in the field of view of the SEM image are projected in circles by the above-described method, and the closest distance (hereinafter denoted as d) between the individual oxide aggregates 5 is measured (FIG. 4C). An oxide aggregate 5A which becomes the center is determined, and the closest distance d is measured. The closest distance d between the oxide aggregates 5 is a distance obtained by determining an oxide aggregate 5B closest to the given oxide aggregate 5A and finding the distance between them. Therefore, one oxide aggregate 5A has one closest distance d. The closest distance d is determined to be a value ($d=D-r1-r2$) obtained by subtracting a radius r1 of the oxide aggregate 5A and a radius r2 of the oxide aggregate 5B from a line segment (D) connecting the centers of the oxide aggregate 5A and the oxide aggregate 5B.

(Step 4)

Figure 5:
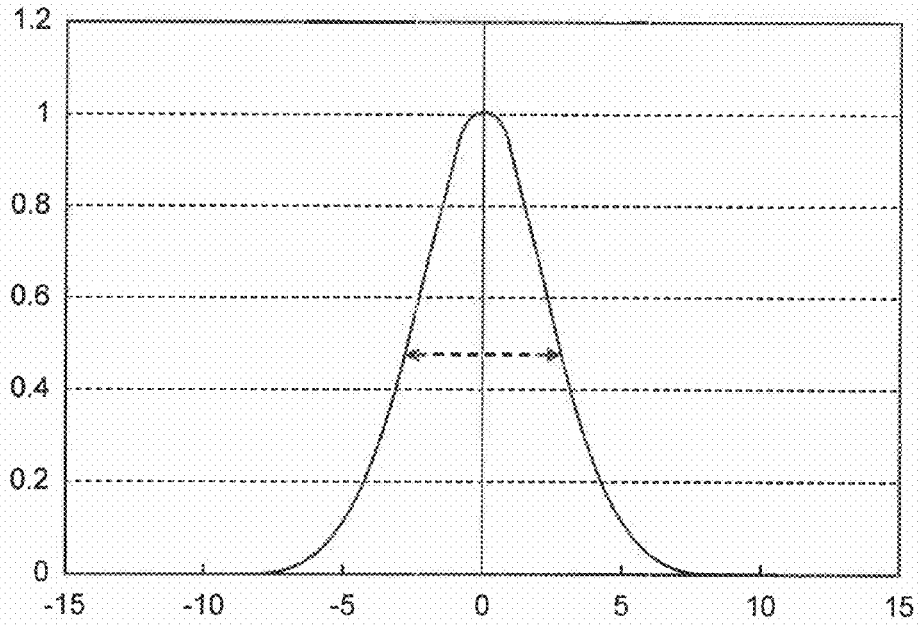
FIG. 5 is a diagram showing an example of a normal distribution of diameters of oxide aggregates in a sintered body.
Figure 6:
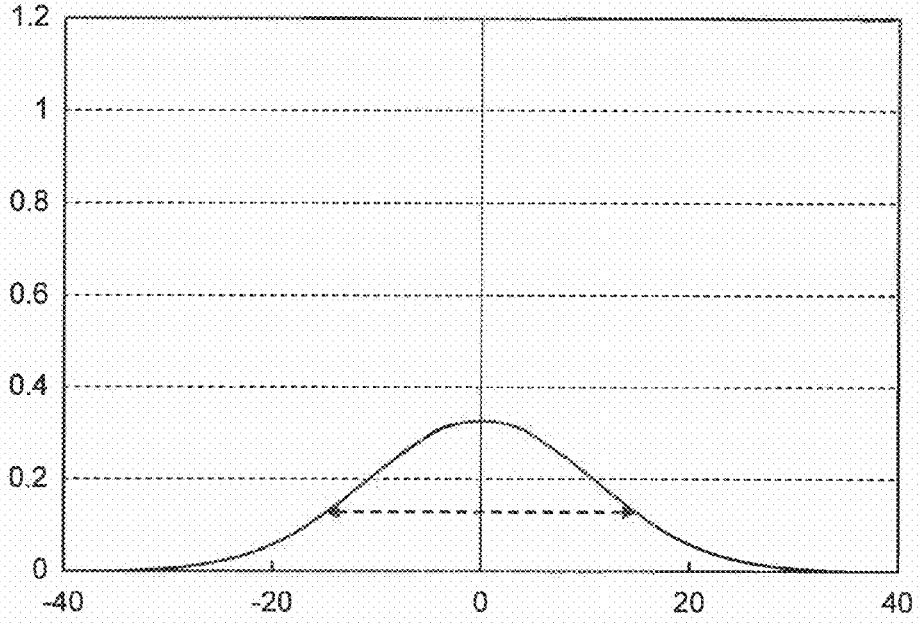
FIG. 6 is a diagram showing an example of a normal distribution of the closest distance between oxide aggregates in a sintered body.

An average diameter (μr) and a standard deviation (σr) of the oxide aggregates 5 are determined from the diameter of the oxide aggregate 5 determined in Step 2, and a normal distribution is plotted (FIG. 5). A half-value width (Γr) is determined from the normal distribution. And, an average value (μd) of the closest distance d of the oxide aggregates 5 and a standard deviation (σd) are determined from the closest distance d of the oxide aggregate 5 determined in Step 3, and a normal distribution is plotted (FIG. 6). A half-value width (Γd) is determined from the normal distribution.

It is determined that the average diameter of the oxide aggregates denotes the average diameter (μr) determined in Steps 1 to 4 described above. The average diameter denotes the average value of the measured values obtained from at least five of the examined sample. The state that the oxide aggregates are substantially uniformly dispersed in the sintered body denotes a case that the half-value width (Γr) of the normal distribution of the diameters of the oxide aggregates 5 determined in Steps 1 to 4 described above is less than 25 (Γr<25), and the half-value width (Γd) of the normal distribution of the closest distances of the oxide aggregates 5 determined in Step 1 to 4 described above is less than 10 (Γd<10). When the above conditions are satisfied, the density of the sintered body can be improved.

A permanent magnet made of a sintered body having a density of 8 g/cm$^3$ or more can be obtained by satisfying the dispersed state and the average diameter of the oxide aggregates described above. In addition, a degree of orientation of the sintered body can be controlled to 80% or more. Thus, it becomes possible to improve the magnet characteristics of the permanent magnet. The degree of orientation of the sintered body is defined by the following formula (2).

$$\text{Degree of orientation (\%)} = Mr/Ms \times 100 \quad (2)$$

In the formula (2), Ms denotes saturation magnetization, which is maximum magnetization obtained when a magnetic field of 1200 to 1600 kA/m is applied. And, Mr denotes residual magnetization, which is magnetization remained when the magnetic field is removed after the magnetic field of 1200 to 1600 kA/m is applied.

To manufacture the sintered body having the dispersed state and the average diameter of the oxide aggregates described above, a formed body of the magnetic powder is preferably sintered in vacuum or in an inert gas atmosphere such as argon gas. Thus, local precipitation of the oxide of the element R is suppressed, and the oxide aggregates can be suppressed. In addition, in the magnetic powder which is used as a material for forming the sintered body, 50 volume % or more of particles in the magnetic powder has a particle diameter of 3 μm or more, and 50 volume % or more of the particles, which has the particle diameter of 3 μm or more, has a particle diameter of 10 μm or less. When the magnetic powder having the above grain size distribution is used, the oxygen content in the sintered body is controlled, and excessive aggregation of the oxide of the element R and an increase in the average diameter of the oxide aggregates can be suppressed.

The magnetic powder having the grain size distribution described above also acts effectively on the degree of orientation of the sintered body. The permanent magnet of the embodiment is oriented by rotating a crystalline c axis, which is the axis of easy magnetization of a $Th_2Zn_{17}$ crystal phase, to become parallel with a magnetization application direction by performing the compression forming of the magnetic powder in the magnetic field as described above. It is ideal that all the crystalline c axes of the magnetic powder grains are parallel with the magnetization application direction. If crystals not having all the c axes aligned are contained, magnetization becomes low in comparison with the sintered body having an ideal orientation texture.

In order to make the sintered body to high density, it is desired that the particle diameter of the magnetic powder is small. But, if the magnetic powder has an extremely small particle diameter, torque required to rotate the magnetic powder cannot be obtained. When each of the magnetic powder grains has characteristics similar to the magnet and the magnetic powder grains are aggregated mutually to stabilize, the magnetic powder grains might not rotate even if an external magnetic field is applied. When the above magnetic powder is used, the degree of orientation of the sintered body decreases. In order not to increase excessively the oxide in the sintered body, it is desired that the particle diameter of the magnetic powder is large. But, if the particle diameter of the magnetic powder is excessively large, the high density of the sintered body cannot be obtained. If the particle diameter of the magnetic powder is excessively small, one magnetic particle contains a large number of crystal grains and has a polycrystalline state. In the above powder, the crystal c axes of the individual crystal grains are not necessarily directed in the same direction, and there is a possibility that a decrease in magnetization is caused.

The existence of the magnetic powder having a particle diameter of less than 3 μm has a large influence upon the degree of orientation of the sintered body configuring the permanent magnet. Therefore, 50 volume % or more of the magnetic powder has preferably a particle diameter of 3 μm more. Thus, magnetization can be suppressed from decreasing. But, when the magnetic powder has an excessively large particle diameter, it results in prevention of the sintered body from having a high density. Therefore, 50 volume % or more of the magnetic powder having a particle diameter of 3 μm or more preferably has a particle diameter of 10 μm or less. Use of the magnetic powder having the above grain size distribution makes it possible to provide the sintered body with both a high density and a high degree of orientation.

According to this embodiment, an Sm—Co based magnet comprised of the high-density sintered body can be provided after the magnetization is improved by increasing the iron concentration. Therefore, the Sm—Co based magnet which shows good heat resistance and excels in magnet characteristics such as a coercive force, magnetization and the like can be provided at a low cost. The permanent magnet is suitable for motors and power generators. The motor provided with the permanent magnet of this embodiment includes general permanent magnet motors and variable magnetic flux motors. As power generators provided with the permanent magnet of this embodiment, there are general permanent magnet generators and variable magnetic flux generators.

When the permanent magnet of this embodiment is used as a stationary magnet or a variable magnet, a system of a variable magnetic flux motor or a variable magnetic flux generator can be made highly efficient, compact, inexpensive, low power consumption and the like. The permanent magnet of this embodiment is suitable for the stationary magnet. The permanent magnet having the coercive force of 500 kA/m or less can be used as the variable magnet. For the structure and drive system of the variable magnetic flux motor, the technologies disclosed in JP-A 2008-29148 (KOKAI) and JP-A 2008-43172 (KOKAI) can be applied.

Figure 7:
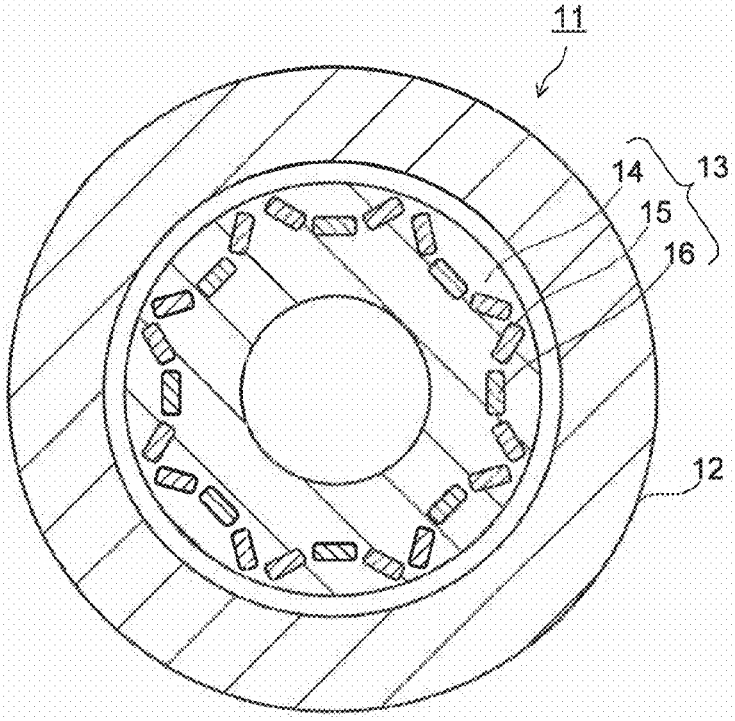
FIG. 7 is a diagram showing a motor of an embodiment.
Figure 8:
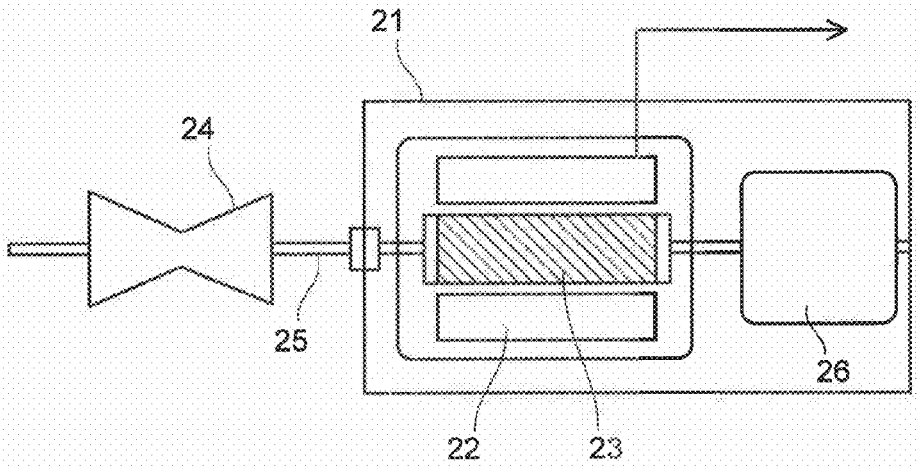
FIG. 8 is a diagram showing a generator of an embodiment.

The variable magnetic flux motor and the variable magnetic flux generator of this embodiment are described below with reference to the drawings. FIG. 7 shows the variable magnetic flux motor of the embodiment, and FIG. 8 shows the variable magnetic flux generator of the embodiment. The permanent magnet of the embodiment is suitable for the magnet of the variable magnetic flux motor and the variable magnetic flux generator, but the application of the permanent magnet of the embodiment to the permanent magnet motors and the like is not prevented.

In the variable magnetic flux motor 11 shown in FIG. 7, a rotor 13 is disposed inside a stator 12. Stationary magnets 15 and variable magnets 16 using permanent magnets with a coercive force lower than that of the stationary magnets 15 are arranged in an iron core 14 within the rotor 13. It is determined that the magnetic flux density (flux content) of the variable magnets 16 can be changed. The variable magnets 16 have a magnetization direction perpendicular to a Q axis direction, so that they are not affected by a Q axis current and can be magnetized by a D axis current. The rotor 13 is provided with a magnetizing winding (not shown) and has a structure such that the magnetic field directly acts on the variable magnets 16 when an electric current is passed from a magnetizing circuit to the magnetizing winding.

In the variable magnetic flux motor 11 shown in FIG. 7, the permanent magnet of the embodiment can be used for both of the stationary magnets 15 and the variable magnets 16, but the permanent magnet of the embodiment may be used for one of them. The permanent magnet of the embodiment is suitable for the stationary magnets 15. The variable magnetic flux motor 11 can output a large torque from a small device size, so that it is suitable for motors of hybrid electric vehicles and electric vehicles, which require that the motors have a high output and a small size.

The variable magnetic flux generator 21 shown in FIG. 8 is provided with a stator 22 using the permanent magnet of the embodiment. A rotor 23 arranged inside the stator 22 is connected to a turbine 24, which is disposed at one end of the variable magnetic flux generator 21, through a shaft 25. The turbine 24 is configured to be rotated by, for example, a fluid supplied from outside. Instead of the turbine 24 which is rotated by the fluid, the shaft 25 can also be rotated by transmitting dynamic rotations such as regenerative energy or the like of the automobile. For the stator 22 and the rotor 23, a variety of known structures can be adopted.

And, the shaft 25 is in contact with a commutator (not shown) which is disposed on the side opposite to the turbine 24 with respect to the rotor 23, and an electromotive force generated by the rotations of the rotor 23 is raised to a system voltage and transmitted via a phase separation bus and a main transformer (not shown) as the output of the variable magnetic flux generator 21. Since the rotor 23 is electrically charged by static electricity from the turbine 24 or by axis current associated with the power generation, the variable magnetic flux generator 21 is provided with a brush 26 for discharging the electrical charge of the rotor 23.

Examples and their evaluated results will be described below.

Examples 1 to 3

Individual raw materials were weighed to have the compositions shown in Table 1 and arc-melted in an Ar gas atmosphere to manufacture alloy ingots. The alloy ingots were subjected to a heating treatment in an Ar atmosphere under conditions of 1170° C. and 1 hour. The alloy was coarsely crushed and then finely ground by a jet mill to manufacture alloy powder (magnetic powder). Three types of magnetic powders having the particle diameter ratio shown in Table 1 were manufactured with the grinding conditions using the jet mill changed. The compositions of the alloy were checked by ICP emission spectra-photometric analysis.

The three types of magnetic powders were then pressed in a magnetic field to manufacture formed bodies. The formed bodies were sintered in an Ar gas atmosphere under conditions of 1210° C. and 3 hours and subsequently subjected to solution heat treatment under conditions of 1170° C. and 1 hour. The obtained sintered bodies were thermally treated under conditions of 850° C. and 4 hours for aging treatment, cooled down to 600° C. at a cooling rate of 1.2° C./minute, and further furnace-cooled to room temperature to manufacture target permanent magnets. The obtained permanent magnets (sintered magnets) were subjected to the characteristic evaluation described later.

Examples 4 to 6

Individual raw materials were weighed to have the compositions shown in Table 1 and arc-melted in an Ar gas atmosphere to manufacture alloy ingots. The individual alloy ingots were attached to a quartz nozzle and melted by high-frequency induction heating. The molten metal was poured in a cooling roll which rotates at a circumferential velocity of 0.6 m/sec and continuously solidified to manufacture a thin strip. The thin strip was coarsely crushed and then finely ground by a jet mill to manufacture alloy powder (magnetic powder). Three types of magnetic powders having particle diameter ratios shown in Table 1 were manufactured with the grinding conditions using the jet mill changed.

The three types of magnetic powders were then pressed in a magnetic field to manufacture formed bodies. The formed bodies were sintered in an Ar gas atmosphere under conditions of 1250° C. and 1 hour and subsequently subjected to solution heat treatment under conditions of 1190° C. and 4 hours. The obtained sintered bodies were subjected to a heating treatment under conditions of 850° C. and 8 hours as aging treatment, cooled down to 450° C. at a cooling rate of 1.3° C./min, and further furnace-cooled to room temperature to manufacture target permanent magnets. The obtained permanent magnets (sintered magnets) were subjected to the characteristic evaluation described later.

Examples 7 to 9

Using a raw material mixture weighed to have the compositions shown in Table 1, alloy powder (magnetic powder) was prepared in the same manner as in Example 5. At that time, three types of magnetic powders having particle diameter ratios shown in Table 1 were manufactured with the crushing conditions using the jet mill changed. Those magnetic powders were used to manufacture permanent magnets (sintered bodies) under the same conditions as in Example 5. The obtained permanent magnets (sintered magnets) were subjected to the characteristic evaluation described later.

Example 10

Using a raw material mixture weighed to have the composition shown in Table 1, magnetic powder (alloy powder) was manufacture in the same manner as in Example 1. The obtained magnetic powder was used to manufacture a permanent magnet (sintered body) under the same conditions as in Example 4. The obtained permanent magnet (sintered magnet) was subjected to the characteristic evaluation described later.

Comparative Example 1

Using the alloy having the same composition as in Example 1, magnetic powder (alloy powder) having the particle diameter distribution shown in Table 1 was manufactured. The obtained magnetic powder was used to manufacture a permanent magnet (sintered body) under the same conditions as in Example 1. The obtained permanent magnet was subjected to the characteristic evaluation described later.

Comparative Example 2

Using the alloy having the same composition as in Example 7, magnetic powder (alloy powder) having the particle diameter distribution shown in Table 1 was manufactured. The obtained magnetic powder was used to manufacture a permanent magnet (sintered body) under the same conditions as in Example 1. The obtained permanent magnet was subjected to the characteristic evaluation described later.

Comparative Example 3

Using the alloy having the same composition as in Example 9, magnetic powder (alloy powder) having the particle diameter distribution shown in Table 1 was manufactured. The obtained magnetic powder was used to manufacture a permanent magnet (sintered body) under the same conditions as in Example 1. The obtained permanent magnet was subjected to the characteristic evaluation described later.

Comparative Examples 4 to 7

Using a raw material mixture weighed to have the compositions shown in Table 1, magnetic powder was prepared and permanent magnets (sintered bodies) were manufactured in the same manner as in Example 1. The obtained permanent magnets were subjected to the characteristic evaluation described later.

The oxygen concentrations of the permanent magnets of Examples 1 to 10 and Comparative Examples 1 to 7 were measured by an inert gas fusion-infrared-ray absorption method (Brand name: Model TC-600 manufactured by LECO). The results are shown in Table 2. Table 2 shows the oxygen concentrations together with the values obtained by converting them into the w value of the formula (1). Then, an average diameter (μr) of oxide aggregates in the permanent magnet, a half-value width (Γr) of the normal distribution plotted from the average diameter (μr) and the standard deviation (σr), an average value (μd) of the closest distance of the oxide aggregates, a half-value width (Γd) of the normal distribution plotted from the average value (μd) and the standard deviation (σd) were determined according to the above-described method. The results are shown in Table 2.

Then, the densities of the permanent magnets were measured by an Archimedes method. The results are shown in Table 3. The magnetic characteristics of the permanent magnets were evaluated by a BH tracer, and residual magnetization Mr, saturation magnetization Ms, and coercive force Hcj were measured. The magnetic characteristics were evaluated by applying an external magnetic field of 1600 kA/m or more to the axis of easy magnetization of a rectangular sintered magnet in a demagnetized state. The residual magnetization Mr, the coercive force Hcj, and the degree of orientation determined from the residual magnetization Mr and the saturation magnetization Ms according to the above-described method are shown in Table 3.

TABLE 1

| | Magnetic powder | | | |
|---|---|---|---|---|
| | Composition | Particle diameter ratio (volume %) | | |
| | (atomic ratio) | <3 μm | 3 to 10 μm | 10 μm< |
| E1 | $(Sm_{0.85}Nd_{0.15})(Fe_{0.28}Zr_{0.025}Cu_{0.055}Co_{0.64})_{7.8}$ | 20 | 50 | 30 |
| E2 | $(Sm_{0.85}Nd_{0.15})(Fe_{0.28}Zr_{0.025}Cu_{0.055}Co_{0.64})_{7.8}$ | 10 | 60 | 30 |
| E3 | $(Sm_{0.85}Nd_{0.15})(Fe_{0.28}Zr_{0.025}Cu_{0.055}Co_{0.64})_{7.8}$ | 40 | 40 | 20 |
| E4 | $Sm(Fe_{0.31}(Ti_{0.1}Zr_{0.9})_{0.04}Cu_{0.06}Co_{0.59})_{8.2}$ | 32 | 58 | 10 |
| E5 | $Sm(Fe_{0.31}(Ti_{0.1}Zr_{0.9})_{0.04}Cu_{0.06}Co_{0.59})_{8.2}$ | 8 | 62 | 30 |
| E6 | $Sm(Fe_{0.31}(Ti_{0.1}Zr_{0.9})_{0.04}Cu_{0.06}Co_{0.59})_{8.2}$ | 38 | 32 | 30 |
| E7 | $Sm(Fe_{0.33}Zr_{0.04}Cu_{0.055}Co_{0.575})_{8.3}$ | 5 | 85 | 10 |
| E8 | $Sm(Fe_{0.33}Zr_{0.04}Cu_{0.055}Co_{0.575})_{8.3}$ | 14 | 58 | 28 |
| E9 | $Sm(Fe_{0.33}Zr_{0.04}Cu_{0.055}Co_{0.575})_{8.3}$ | 40 | 53 | 7 |
| E10 | $Sm(Fe_{0.34}Zr_{0.03}Cu_{0.055}Mn_{0.005}Co_{0.57})_{7.6}$ | 11 | 59 | 30 |
| CE1 | $(Sm_{0.85}Nd_{0.15})(Fe_{0.28}Zr_{0.025}Cu_{0.055}Co_{0.64})_{7.8}$ | 65 | 20 | 15 |
| CE2 | $Sm(Fe_{0.33}Zr_{0.04}Cu_{0.055}Co_{0.575})_{8.3}$ | 69 | 22 | 9 |
| CE3 | $Sm(Fe_{0.33}Zr_{0.04}Cu_{0.055}Co_{0.575})_{8.3}$ | 5 | 15 | 80 |
| CE4 | $(Sm_{0.85}Nd_{0.15})(Fe_{0.65}Zr_{0.025}Cu_{0.055}Co_{0.27})_{7.8}$ | 20 | 50 | 30 |
| CE5 | $(Sm_{0.85}Nd_{0.15})(Fe_{0.28}Zr_{0.003}Cu_{0.055}Co_{0.662})_{7.8}$ | 38 | 40 | 22 |
| CE6 | $Sm(Fe_{0.33}Zr_{0.04}Cu_{0.12}Co_{0.51})_{8.3}$ | 16 | 55 | 29 |
| CE7 | $Sm(Fe_{0.34}Zr_{0.03}Cu_{0.055}Mn_{0.005}Co_{0.57})_{9.2}$ | 15 | 53 | 32 |

* E = Example; CE = Comparative Example

TABLE 2

| | Sintered body | | | | | |
|---|---|---|---|---|---|---|
| | | | Aggregate of oxide | | | |
| | | | Diameter | | Closest distance | |
| | Oxygen concentration (mass %) | Oxygen Amount (W) | Average value μr (μm) | Half-value width Γr | Average value μd (μm) | Half-value width Γd |
| Example 1 | 0.65 | 0.250 | 5.0 | 23 | 18 | 8 |
| Example 2 | 0.25 | 0.096 | 5.5 | 22 | 15 | 7 |
| Example 3 | 0.88 | 0.336 | 8.0 | 23 | 14 | 9 |
| Example 4 | 0.80 | 0.319 | 7.0 | 19 | 15 | 8 |
| Example 5 | 0.23 | 0.092 | 6.0 | 18 | 17 | 8 |
| Example 6 | 0.75 | 0.299 | 8.0 | 22 | 27 | 9 |
| Example 7 | 0.55 | 0.221 | 3.0 | 22 | 15 | 9 |
| Example 8 | 0.32 | 0.129 | 5.0 | 20 | 13 | 6 |
| Example 9 | 0.85 | 0.342 | 8.0 | 26 | 25 | 6 |
| Example 10 | 0.16 | 0.060 | 4.2 | 18 | 6 | 4.4 |
| Comparative Example 1 | 1.80 | 0.688 | 20.0 | 27 | 19 | 15 |
| Comparative Example 2 | 2.25 | 0.860 | 15.0 | 28 | 20 | 14 |
| Comparative Example 3 | 0.01 | 0.004 | 3.5 | 16 | 25 | 20 |
| Comparative Example 4 | 0.68 | 0.260 | 5.1 | 25 | 17 | 9 |
| Comparative Example 5 | 0.86 | 0.326 | 8.0 | 22 | 14 | 9 |
| Comparative Example 6 | 0.40 | 0.154 | 5.5 | 24 | 17 | 7 |
| Comparative Example 7 | 0.20 | 0.087 | 4.8 | 20 | 6 | 4.3 |

TABLE 3

| | Sintered body | | | |
|---|---|---|---|---|
| | Density ($g/cm^3$) | Degree of orientation (%) | Residual magnetization (T) | Coercive force (kA/m) |
| Example 1 | 8.12 | 83 | 1.14 | 1000 |
| Example 2 | 8.17 | 88 | 1.18 | 1200 |
| Example 3 | 8.06 | 81 | 1.12 | 420 |
| Example 4 | 8.14 | 84 | 1.16 | 480 |
| Example 5 | 8.17 | 87 | 1.18 | 840 |
| Example 6 | 8.08 | 82 | 1.15 | 800 |
| Example 7 | 8.20 | 85 | 1.22 | 590 |
| Example 8 | 8.15 | 84 | 1.21 | 380 |
| Example 9 | 8.11 | 82 | 1.19 | 230 |
| Example 10 | 8.00 | 90 | 1.19 | 830 |
| Comparative Example 1 | 7.95 | 63 | 1.06 | 280 |
| Comparative Example 2 | 7.91 | 65 | 1.03 | 95 |
| Comparative Example 3 | 7.64 | 51 | 0.97 | 72 |
| Comparative Example 4 | 7.89 | 86 | 1.30 | 12 |
| Comparative Example 5 | 8.01 | 84 | 1.11 | 18 |
| Comparative Example 6 | 7.95 | 81 | 0.86 | 105 |
| Comparative Example 7 | 7.84 | 78 | 1.01 | 25 |

It is apparent from Table 3 that all the permanent magnets of Examples 1 to 10 have high density and excellent magnet characteristics. Meanwhile, it is seen that the permanent magnets of Comparative Examples 1 and 2 have low density because the oxygen concentration is high, the oxide aggregates have a large average diameter and the oxide aggregates are present non-uniformly. It is seen that the permanent magnet of Comparative Example 3 has low coercive force because the oxygen concentration is low. Further, the permanent magnet of Comparative Example 3 has small magnetization because the density is low. It is seen that the permanent magnets of Comparative Examples 4 to 7 are not provided with satisfactory magnet characteristics because the compositions of Comparative Examples 4 to 7 fall outside of the composition represented by the formula (1).

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A permanent magnet comprising a sintered body having a composition represented by the following composition formula:

$$R(Fe_pM_qCu_rCo_{1-p-q-r})_zO_w,$$

wherein R is at least one element selected from the group consisting of rare-earth elements, M is at least one element selected from the group consisting of Ti, Zr and Hf, p is a number, which is an atomic ratio, satisfying $0.25 \le p \le 0.6$, q is a number, which is an atomic ratio, satisfying $0.005 \le q \le 0.1$, r is a number, which is an atomic ratio, satisfying $0.01 \le r \le 0.1$, z is a number, which is an atomic ratio, satisfying $4 \le z \le 9$, and w is a number, which is an atomic ratio, satisfying $0.005 \le w \le 0.6$, wherein aggregates of oxides containing the element R are substantially uniformly dispersed in the sintered body.

2. The permanent magnet according to claim 1, wherein a half-value width of a normal distribution determined from a standard deviation and an average value of diameters of the aggregates is less than 25, and a half-value width of a normal distribution determined from a standard deviation and an average value of closest distances of the aggregates is less than 10.

3. The permanent magnet according to claim 2, wherein the aggregates have an average diameter of 10 μm or less.

4. The permanent magnet according to claim 3, wherein the sintered body has a density of 8 $g/cm^3$ or more and a degree of orientation of 80% or more.

5. The permanent magnet according to claim 4, wherein 50 atomic % or more of the element R is samarium.

6. The permanent magnet according to claim 5, wherein 50 atomic % or more of the element M is zirconium.

7. The permanent magnet according to claim 1, wherein 20 atomic % or less of Co is substituted by at least one element selected from the group consisting of Ni, V, Cr, Mn, Al, Ga, Nb, Ta, and W.

8. A method for manufacturing a permanent magnet, comprising:

forming a magnetic powder having a composition represented by the following composition formula:

$$R(Fe_pM_gCu_rCo_{1-p-q}\text{-}O_z,$$

wherein R is at least one element selected from the group consisting of rare-earth elements, M is at least one element selected from the group consisting of Ti, Zr and Hf, p is a number, which is an atomic ratio, satisfying $0.25 \leq p \leq 0.6$, q is a number, which is an atomic ratio, satisfying $0.005 \leq q \leq 0.1$, r is a number, which is an atomic ratio, satisfying $0.01 \leq r \leq 0.1$, and z is a number, which is an atomic ratio, satisfying $4 \leq z \leq 9$, press-forming the magnetic powder in a magnetic field, thereby forming a formed body;

sintering the formed body in a vacuum atmosphere or an inert gas atmosphere, thereby forming a sintered body having a composition represented by the following composition formula:

$$R(Fe_pM_qCu_rCo_{1-p-q-r})_zO_w,$$

wherein R is at least one element selected from the group consisting of rare-earth elements, M is at least one element selected from the group consisting of Ti, Zr and Hf, p is a number, which is an atomic ratio, satisfying $0.25 \leq p \leq 0.6$, q is a number, which is an atomic ratio, satisfying $0.005 \leq q \leq 0.1$, r is a number, which is an atomic ratio, satisfying $0.01 \leq r \leq 0.1$, z is a number, which is an atomic ratio, satisfying $4 \leq z \leq 9$, w is a number, which is an atomic ratio, satisfying $0.005 \leq w \leq 0.6$;

performing a solution treatment on the sintered body; and performing an aging treatment on the sintered body after the solution treatment by holding the sintered body at a temperature in a range of from 700° C. to 900° C., and cooling the sintered body to a temperature in a range of from 400° C. to 650° C. at a cooling rate of 1.3° C./min or less, wherein 50 volume % or more of particles in the magnetic powder has a particle diameter of 3 μm or more, and 50 volume % or more of the particles having the particle diameter of 3 μm or more has a particle diameter of 10 μm or less.

9. A motor comprising the permanent magnet according to claim 1.

10. A power generator comprising the permanent magnet according to claim 1.

11. The method according to claim 8, wherein 50 volume % or more and about 89.5 volume % or less of the particles having the particle diameter of 3 μm or more has a particle diameter of 10 μm or less.

12. The method according to claim 8, wherein the cooling rate of the sintered body is from 0.2° C./min to 1.3° C./min.

13. The method according to claim 8, wherein the cooling rate of the sintered body is from 0.5° C./min to 1.3° C./min.

14. The method according to claim 8, wherein the aging treatment is performed by holding the sintered body at a first temperature in a range of from 700° C. to 900° C. for from 0.5 hour to 16 hours, cooling the sintered body to a second temperature in a range of from 400° C. to 650° C. at the cooling rate, holding the sintered body at the second temperature, and cooling the sintered body to room temperature.

* * * * *